US006883477B2

(12) United States Patent
Wakeman

(10) Patent No.: US 6,883,477 B2
(45) Date of Patent: Apr. 26, 2005

(54) APPARATUS FOR DEACTIVATING AN ENGINE VALVE

(75) Inventor: Russell J. Wakeman, Canton, MI (US)

(73) Assignee: Ricardo, Inc., Van Buren Township, MI (US)

( * ) Notice: Subject to any disclaimer, the term of this patent is extended or adjusted under 35 U.S.C. 154(b) by 63 days.

(21) Appl. No.: 10/679,832

(22) Filed: Oct. 6, 2003

(65) Prior Publication Data

US 2004/0065284 A1 Apr. 8, 2004

Related U.S. Application Data

(60) Provisional application No. 60/416,620, filed on Oct. 7, 2002.

(51) Int. Cl.[7] ..... F01L 1/34

(52) U.S. Cl. ..... 123/90.16; 123/90.15; 123/90.12

(58) Field of Search ..... 123/90.16, 90.15, 123/90.12, 90.11

(56) References Cited

U.S. PATENT DOCUMENTS

| | | | | |
|---|---|---|---|---|
| 4,930,463 | A | 6/1990 | Hare, Sr. | |
| 4,930,465 | A | 6/1990 | Wakeman et al. | |
| 5,158,048 | A | 10/1992 | Robnett et al. | |
| 5,829,397 | A | 11/1998 | Vorih et al. | |
| 6,125,828 | A | 10/2000 | Hu | |
| 6,152,104 | A | 11/2000 | Vorih et al. | |
| 6,196,175 | B1 | 3/2001 | Church | |
| 6,253,730 | B1 | 7/2001 | Gustafson | |
| 6,415,752 | B1 | 7/2002 | Janak | |
| 6,450,144 | B1 | 9/2002 | Janak et al. | |
| 6,477,997 | B1 * | 11/2002 | Wakeman | 123/90.16 |

FOREIGN PATENT DOCUMENTS

| | | |
|---|---|---|
| DE | 35 37 630 | 4/1986 |
| DE | 42 02 507 | 8/1992 |

* cited by examiner

*Primary Examiner*—Thomas Denion
*Assistant Examiner*—Zelalem Eshete
(74) *Attorney, Agent, or Firm*—MacMillan, Sobanski & Todd, LLC

(57) ABSTRACT

An apparatus for deactivating an engine valve has an accumulator sleeve slidably retained in an engine block and biased toward a lower chamber in fluid communication with an interior of the sleeve. A follower piston slides in the sleeve in contact with a lobe of a can. An upper piston slides in an upper chamber in contact with a pushrod. A fluid passage connects the lower chamber and the upper chamber. A normally open spool valve in the fluid passage includes a control spool for opening and closing the passage. Another passage connects the lower chamber and one end of the control spool. A spring chamber provides fluid to an opposite end of the control spool through a control valve from a source of pressurized fluid.

20 Claims, 3 Drawing Sheets

APPARATUS FOR DEACTIVATING AN ENGINE VALVE

CROSS-REFERENCE TO RELATED APPLICATION

This application claims the benefit of U.S. provisional patent application Ser. No. 60/416,620 filed Oct. 7, 2002.

BACKGROUND OF THE INVENTION

The present invention relates generally to lost motion devices for internal combustion engine valve controllers and, in particular, to a spool valve lost motion valve deactivation apparatus with an integral accumulator.

Internal combustion engines are well known. Internal combustion engines include a valvetrain having intake and exhaust valves disposed in the cylinder head above each combustion cylinder. The intake and exhaust valves connect intake and exhaust ports with each combustion cylinder. The intake and exhaust valves are generally poppet-type valves having a generally mushroom-shaped head and an elongated cylindrical stem extending from the valve head. A spring biases the valve head in a fully closed position against a valve seat in the cylinder head. Historically, engine valves were actuated from the fully closed position to a fully open position by an underhead camshaft, pushrod, and rocker arm assembly. Hydraulic lifters, which utilize pressurized hydraulic fluid to actuate a piston to reciprocate the valve, were added as a buffer between the motion of the rocker arm and the valve stem and as a means for adjusting valve lash. In later developments, overhead camshafts eliminated the pushrod and, occasionally, the rocker arm for a more direct actuation of the valves.

Devices for deactivating engine valves, known in the art as lost motion devices, are also well known. Lost motion devices are advantageous because they increase the efficiency of the engine by either completely eliminating or reducing the stroke of the valve, thereby allowing no or reduced fuel-air mixture or engine exhaust to enter or exit the cylinder respectively. Many prior art hydraulic lost motion devices are capable of reducing the lift and/or duration of a cam lobe event which is transmitted to the engine valve. These devices are typically controlled by a solenoid valve, and the loss of cam motion is accomplished by the dumping of oil out of a hydraulic link between the cam and the valve in a controlled manner. This has two primary disadvantages which have made these systems unacceptable for volume production. The first disadvantage is energy consumption, since the oil is typically pumped by the cam through a small solenoid valve, with excessive energy losses. This energy is taken out of the crank, and results in a fuel economy loss. The second failing of most lost motion systems is that because the devices use only a portion of the cam lobe, the opening and closing ramps are lost, which results in unacceptably high opening and closing acceleration rates, causing noise, wear, valve bounce, and high frequency stresses. Another concern with prior art lost motion devices is the hydraulic pressures at which they must operate, inevitably making the control solenoid large, causing high power consumption, and rendering the solenoid unable to open against extremes of oil pressure.

In addition, there is an increased interest in the ability of modem microcontrollers to control added engine valve events beyond those of a conventional camshaft, for example, to operate homogeneous charge compression ignition (HCCl) engines, to controlling diesel NOx emissions, and for compression brakes. In the case of NOx control, the strategy is to add an extra intake valve event during the exhaust stroke, or an added exhaust valve event on the intake stroke for the purpose of delivering added residual gas to the next combustion event. In the case of the compression brake, the strategy is to modulate an exhaust valve event at the top of the compression stroke to dump the compression energy to serve as a retarder. In the case of HCCl, one strategy for the control of HCCl ignition is to deliver exhaust to the cylinder in modulated amounts (extra exhaust event on the intake stroke) to control the cylinder temperature and possibly active radical chemistry as an ignition timing control.

It is desirable, therefore, to provide a lost motion apparatus that is adapted to provide a full valve event (the conventional valve event as well as the added event), to provide deactivation of the valve event (as when residual is not required) or to provide accurate modulation between these extremes for controlling the residual rate.

SUMMARY OF THE INVENTION

The present invention concerns an apparatus for deactivating an engine valve. The apparatus includes an accumulator sleeve slidably retained in an engine block and biased toward a lower chamber formed in the engine block. An interior of the sleeve is in fluid communication with the lower chamber. A follower piston is slidably retained in the sleeve for contact with at least one lobe of a cam. An upper piston is slidably retained in an upper chamber formed in the engine block for contact with a pushrod. A fluid passage is formed in the engine block and is in fluid communication between the lower chamber and the upper chamber. A spool valve is disposed in the fluid passage and includes a control spool for opening and closing the spool valve, the control spool being biased to a valve open position. A passage is formed in the engine block and provides fluid communication between the lower chamber and one end of the control spool. A spring chamber is formed in the engine block and provides fluid communication between an opposite end of the control spool and a source of pressurized fluid.

The apparatus in accordance with the present invention advantageously provides a full lift operation, wherein the apparatus provides a full valve event including the conventional valve event as well as the added residual event. The apparatus also provides a no lift operation, as when the residual event is not required. The apparatus also provides a partial lift operation, providing accurate modulation between the full lift operation and the no lift operation outlined above.

In addition, the apparatus in accordance with the present invention accomplishes valve control in a robust and cost-effective way, without using excessive energy, which adversely impacts fuel economy. The apparatus may or may not be utilized with an EGR cam lobe on the camshaft. Preferably, an apparatus in accordance with the present invention is attached to each valve of the engine. Since the apparatus in accordance with the present invention uses the opening and closing ramps of the cam lobe there is no concern of valve-closing noise or wear, and does not require additional noise-dampening devices. Since the flowing control oil is not forced through a small solenoid orifice, either during normal operation or lost motion, the hydraulic losses are minimal. Since the solenoid is only controlling pilot flow, losses are small there as well. And since the solenoid flow area is small, pressure loads are small, and a relatively small package and power consumption is possible. Since the valve lifting pressure provides the force to close the spool, there is no need for an extra hydraulic supply to operate the system. Energy is recovered during the lost motion, and the use of a roller follower makes mechanical losses at the cam minimal.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
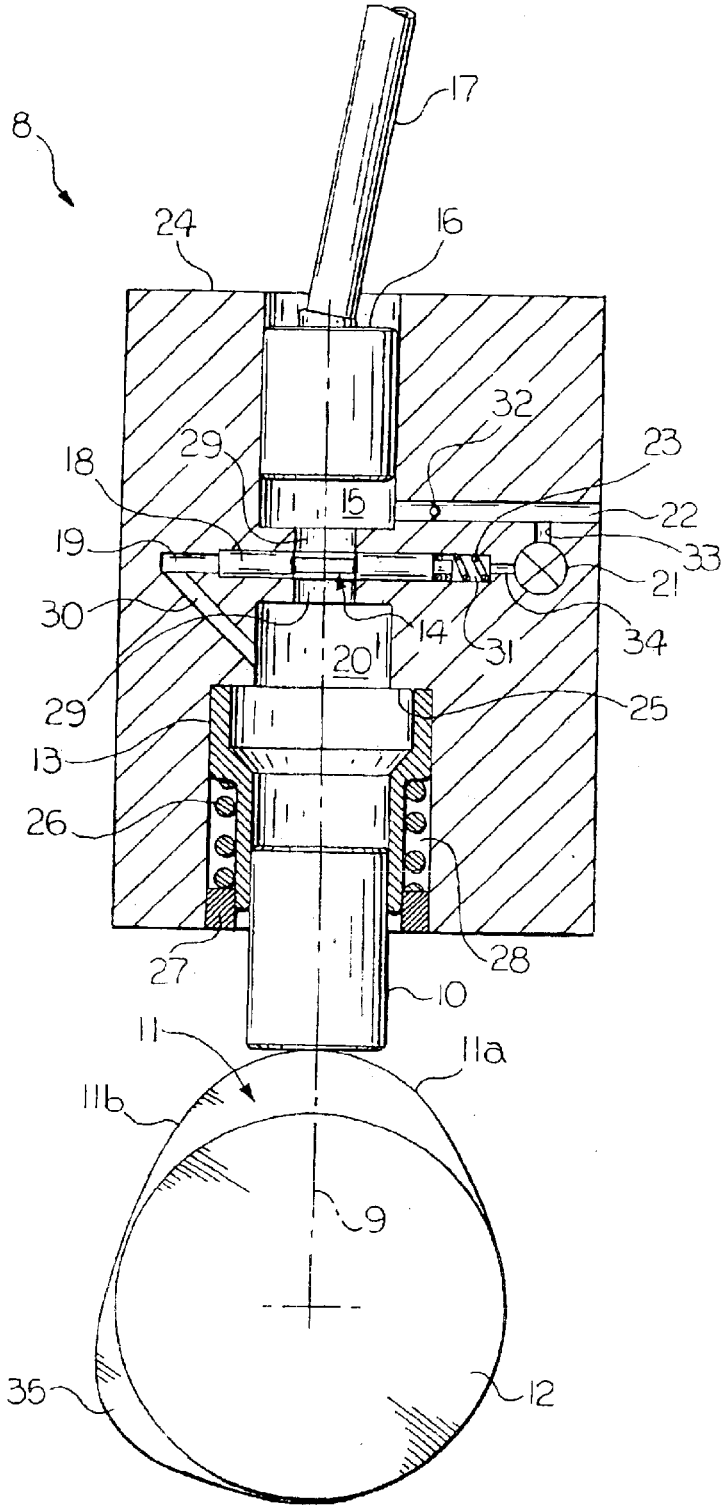
FIG. 1 is a fragmentary schematic partial cross-sectional view of a valve deactivation apparatus in accordance with the present invention installed in an engine block.
Figure 2:
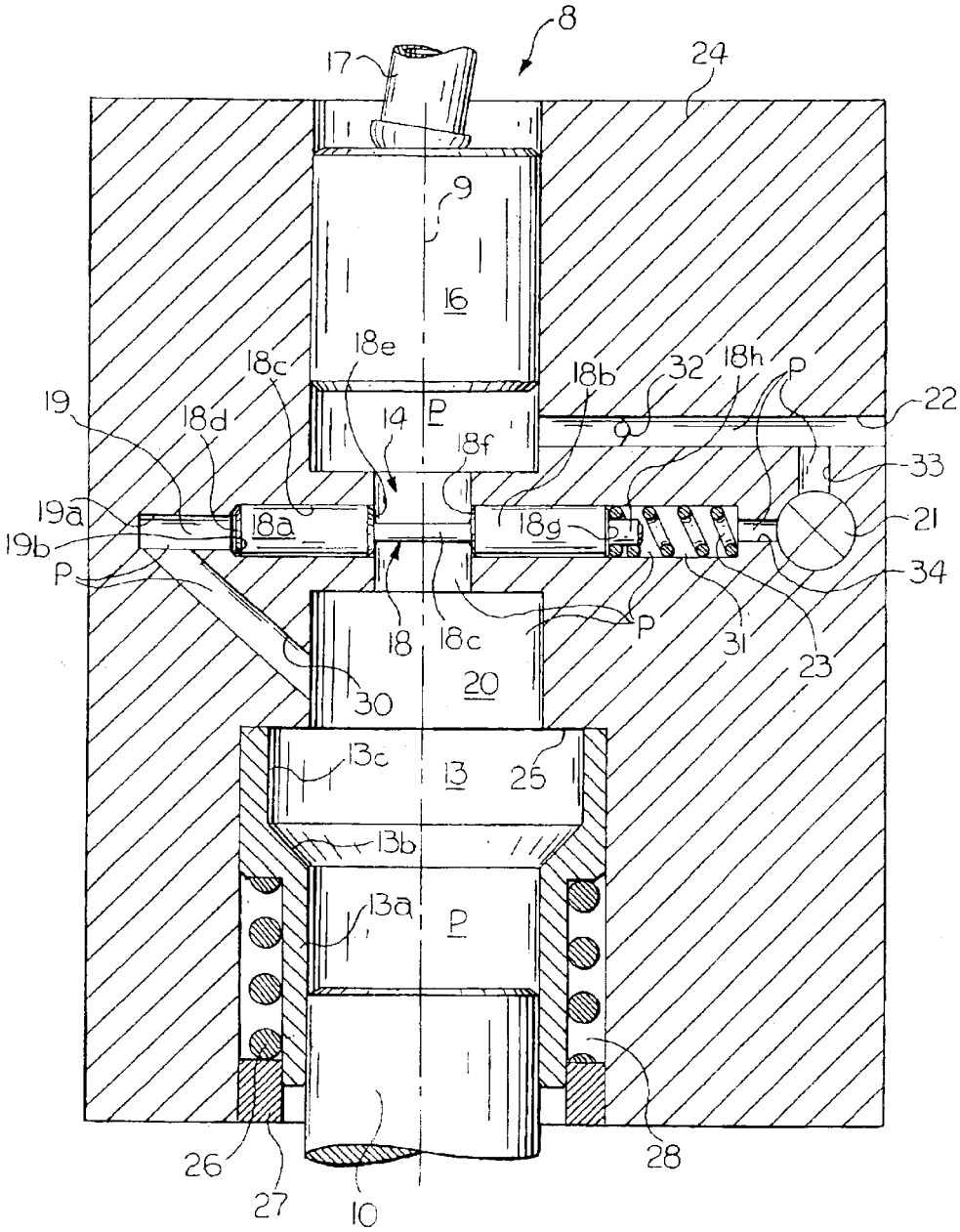
FIG. 2 is an enlarged view of a portion of the apparatus shown in FIG. 1.

There is shown in FIGS. 1 and 2 a spool valve lost motion deactivation apparatus indicated generally at 8 that has a longitudinal axis of operation 9. The apparatus 8 is preferably adapted to be integrated into a valve train of an internal combustion engine and includes a follower piston 10 that is in contact with and follows the motion of a cam lobe 11 formed on a cam 12. The follower piston 10 is slidably disposed in an accumulator sleeve 13. The accumulator sleeve 13 includes a lower portion 13*a* having a first diameter and an upper portion 13*c* having a second diameter, larger than said first diameter. The portions 13*a* and 13*c* are connected by an angled portion 13*b*. The apparatus 8 also includes a spool valve 14 that controls fluid communication between the interior of the sleeve 13 and an upper chamber 15. An upper piston 16 slides in the chamber 15 along the axis 9 to reciprocate a pushrod 17. The valve 14 has a spool body 18 with one end slidably retained in a first passage 19 that is in fluid communication with a lower chamber 20 open to the upper portion 13*c* of the sleeve 13. A solenoid control valve 21 selectively connects a lube oil supply passage 22 with the opposite end of the spool body 18. The spool valve is biased to an open position by a return spring 23. The apparatus 8 controls the actuation of the pushrod 17 by the cam 12.

The upper chamber 15, the first passage 19 and the supply passage 22 are all formed in surrounding engine component 24, which can be a cylinder head or an engine block, depending on the configuration of the engine. The upper edge of the upper portion 13*c* of the accumulator sleeve 13 abuts a stop 25 formed by a downwardly facing wall surrounding a lower end of the lower chamber 20. The sleeve 13 is biased upwardly by a return spring 26 that surrounds the lower portion 13*a* and is retained between the accumulator angled portion 13*b* and a retainer 27. The retainer 27 has an annular shape and is mounted at a lower open end of a sleeve cavity 28 formed in the engine component 24. The cavity 28 extends to the wall 25. The spring 26 is preloaded to a value greater than that seen at peak lift during normal valve operation, discussed in more detail below, so that it is not moved during such normal operation.

The lower chamber 20 is open at a lower end to the upper end of the sleeve cavity 28. A second passage 29 is formed in the engine component 24 and connects an upper end of the lower chamber 20 with a lower end of an upper chamber 15 formed in the engine component 24. A third passage 30 formed in the engine component 24 extends from the lower chamber 20 to the first passage 19. The first passage 19 extends transverse to the longitudinal axis 9 and is connected to the second passage 29 between the upper and lower ends thereof. The first passage 19 slidably receives a first portion 18*a* of the spool body 18. A spring chamber 31 formed in the engine component 24 receives a second portion 18*b* of the spool body 18 and extends from the second passage 29 diametrically opposed to the first passage 19. The return spring 23 is disposed in the spring chamber 31.

The lube oil supply passage 22 extends between the upper chamber 15 and a source of pressured oil (not shown) and includes a check valve 32 disposed therein to permit oil flow only into the upper chamber 15. A valve inlet passage 33 and a valve outlet passage 34 are formed in the engine component 24 and are connected between the oil supply passage 22 the valve 21 and between the valve 21 and the spring chamber 28 respectively. In operation, the interior of the sleeve 13, the lower chamber 20, the first passage 19, the second passage 29, the third passage 30, the upper chamber 15, the lube oil supply passage 22, the valve inlet passage 33, the valve outlet passage 34 and the spring chamber 31 are each filled with pressured oil P from the lube oil supply and form a closed hydraulic system.

The upper piston 16 is slidably disposed in the upper chamber 15. The upper piston 16 is connected to the pushrod 17, which is connected to an engine valve (not shown). Depending on the configuration of the engine, the pushrod 17 connected to a rocker (not shown), may be a stem of the valve (not shown), or a portion of a rocker (not shown) connected to the valve. The spool valve 14 is shown in the open position wherein the spool 18 includes a reduced diameter central 18*c* disposed in the second passage 29 and connected between the first portion 18*a* and the second portion 18*b*. The first portion 18*a* is slidably disposed in an enlarged diameter portion 19*c* of the first passage 19. The first portion 18*a* has a first control surface 18*d* biased against a step 19*b* connecting the portion 19*c* with a smaller diameter portion 19*a* of the first passage 19. The first portion 18*a* has a second control surface at the connection to the central portion 18*c*. The second portion 18*b* has a third control surface 18*f* at the connection to the central portion 18*c* and a fourth control surface 18*g* abutting the spring 23. An extension 18*h* extends axially from the fourth control surface 18*g* for facilitating attachment of the spring 23 to the spool body 18. The control surfaces 18*d* and 18*g* have substantially identical surface areas for pressure balancing the spool valve 14 as do the control surfaces 18*e* and 18*f*. The return spring 23 biases the spool body 18 against the oil pressure in the lower chamber 20 to open the spool valve 14 as shown in the figures. In the open position, the central portion 18*c* is disposed in the second passage 29 allowing oil to flow from the lower chamber 20 and through the passage 29 to the upper chamber when the follower piston 10 is moved upwardly by the cam 12.

The valve control surface 18*d*, therefore, is exposed through the third passage 30 and the first passage 19 to the pressured oil in the lower chamber 20 and the valve control surface 18*g* is exposed, through the solenoid control valve 21 and the passages 33 and 34, to lubricating oil pressure from the lube oil supply passage 22. The solenoid valve 21, when in an open mode, is operable to allow flow from the lube oil supply passage 22 to the spring chamber 31. The valve control surfaces 18*e* and 18*f* are exposed to the lubricating oil pressure in the second passage 29.

The operation of the lost motion deactivation apparatus 8 will now be described. In a full lift operation, the solenoid control valve 21 is closed with the spool valve 14 in an open position, which traps any lubricating oil in the spring chamber 31 and immobilizes the spool body 18. When the cam 12 rotates in a clockwise direction and a first ramped portion 11*a* of the outer surface of the cam lobe 11 engages with a lower surface of the follower piston 10, the follower piston 10 moves upwardly and displaces oil in the sleeve 13 and the lower chamber 20. Since the spool valve 14 is open, the oil displaced by the follower piston 10 passes through the second passage 29 and into the upper chamber 15 to move the upper piston 16 upwardly. The movement of the upper piston 16 in turn moves the pushrod 17. As the follower piston 10 moves upwardly, the pressure in the first passage 19 tries to move the spool body 18 against the spring 23 and the oil trapped in the closed spring chamber 31 and may move the spool body 18 slightly, but will not close the valve 14. The trapped oil in the spring chamber 31 and the closed solenoid control valve 21 prevent movement of the spool body 18 because as pressure increases on the valve control surface 18*d*, the oil in the spring chamber 31 does not have an outlet and, as an incompressible fluid, cannot be displaced. The check valve 32 also prevents oil from flowing from the upper chamber 15 to the lube oil supply passage 22, ensuring that the oil displaced in the upper chamber 15 moves the upper piston 16 and the pushrod 17.

As the cam 12 continues to rotate, a second ramped portion 11*b* of the cam lobe 11 contacts the follower piston 10, causing the follower piston 10 to lower and lowering the pressure in the sleeve 13 and the lower chamber 20. The lower pressure, in combination with the valve springs attached to the engine valve forcing the upper piston 16 downwardly cause the follower piston 10 to move downwardly. During the full lift operation described above, the accumulator sleeve 13 is not unloaded and remains stationary. An extra valve event, such as caused by an EGR lobe 35 on the cam 12, operates the apparatus 8 in the same manner in a full lift operation.

In a zero lift operation, the solenoid control valve 21 is actuated to an open mode with the spool valve 14 in an open position, which allows any lubricating oil in the spring chamber 31 to flow to the lube oil supply passage 22. When the cam 12 rotates and the first ramped portion 11*a* of the outer surface of the cam lobe 11 engages with a lower surface of the follower piston 10, the follower piston 10 moves upwardly and displaces oil in the sleeve 13 and the lower chamber 20. Since the spool valve 14 is open, the oil displaced by the follower piston 10 passes through the lower chamber 20, the second passage 29, and the upper chamber 15. As the pressure in the first passage 19 rises above the pressure in the lube oil supply passage 22, because the check valve 32 prevents oil from flowing from the upper chamber 15 into the lube oil supply passage 22, the valve control surfaces 18*d* and 18*g* are exposed to different pressures and the spool body 18 is moved against the return spring 23 and the pressure from the supply passage 22. The first portion 18*a* moves into the second passage 29 to close the valve 14 before the engine valve spring preload is reached, which isolates the upper chamber 15 from oil flow before the engine valve starts to move. After the valve 14 is closed, the lower chamber 20 and the interior of the sleeve 13 are also isolated, increasing the pressure in both as the follower piston 10 rises. The higher pressure acts on the angled surface 13*b* of the accumulator sleeve 13, eventually overcoming the preload of the spring 26 and causing the accumulator 13 to move downwardly. This high pressure may encourage the use of roller followers (not shown) to avoid normal force-driven increases in friction.

As the cam 12 continues to rotate, the second ramped portion 11*b* of the cam lobe 11 contacts the follower piston 10, causing the follower piston 10 to lower and consequently reducing the pressure in the sleeve 13 and the lower chamber 20. As the pressure is reduced, the spring 26 moves the accumulator sleeve 13 upwardly. Eventually the spring 26 returns the energy stored by cam motion back to the cam 12 and the spring 26 returns to a rest position. When the pressure in the lower chamber 20 and the sleeve 13 is reduced, the pressure in the upper chamber 15 and the first passage 19 is also reduced. The pressure on the valve control surfaces 18*d* and 18*g* eventually equalizes allowing the spring 23 to return the valve 14 to the open position. At this point, only a small pilot volume of oil has flowed through the open solenoid valve 21, and the oil to the accumulator sleeve 13 and back has not been forced to flow through an orifice. The EGR lobe 35 operates the apparatus 8 in the same manner in a zero lift operation.

In a partial lift operation, the solenoid control valve 21 is closed with the spool valve 14 in an open position, as in the full lift operation outlined above, which traps any lubricating oil in the spring chamber 31. When the cam 12 rotates and the first ramped portion 11*a* of the outer surface of the cam lobe 11 engages with a lower surface of the follower piston 10, the follower piston 10 moves upwardly and displaces oil in the sleeve 13 and the lower chamber 20. Since the spool valve 14 is open, the oil displaced by the follower piston 10 passes through the lower chamber 20, the second passage 29, and into the upper chamber 15 to move the upper piston 16 upwardly. The upper piston 16 moves in response to the oil flow to drive the pushrod 17, as in the full lift operation outlined above.

At a predetermined point in the motion of the cam 12 corresponding to the desired lift of the engine valve is reached, the solenoid valve 21 is opened, which drives the spool body 18 to the right in FIG. 2 against the combined force of the spring 23 and the lubrication pressure from the lube oil supply passage 22. Thus, the first portion 18*a* moves into the second passage 29 and closes the valve 14. When the valve 14 is closed, this isolates the upper chamber 15 from the lower chamber 20, freezing the engine valve in position, and allowing the remainder of cam lift to be absorbed by the accumulator 13, as in the zero lift operation outlined above. The valve 14 will remain closed as the follower piston 10 goes over the nose of the cam lobe 11, and the spring 26 of the accumulator 13 returns energy as in the zero lift operation outlined above. As the cam 12 rotates, eventually a crank angle will be reached when the follower piston 10 reaches the same lift as at the crank angle when the solenoid valve 21 was opened. At this point, the pressures in the upper chamber 15 and the lower chamber 20 are again equal (as when the solenoid valve 21 was opened), and the spool valve 14 begins to open as the pressure in the lower chamber 20 and on the valve control surface 18*d* drops with the closing motion of the follower piston 10 and the cam 12. With the spool valve 14 open, the upper chamber 15 and the lower chamber 20 are in fluid communication, and the engine valve is under control of the cam 12. This particularly includes the closing ramp 11*b* of the cam lobe 11, which advantageously assures acceptable closing velocities and accelerations of the engine valve. Modulation of the apparatus 8 will be by variation of the predetermined crank angle at which the solenoid valve 21 is opened, which will advantageously allow the lift of the cam 12 to be varied, and will allow the lift-time area under the valve motion curve to be controlled. Similar partial lift operation can be obtained with the EGR lobe 35.

Figure 3:
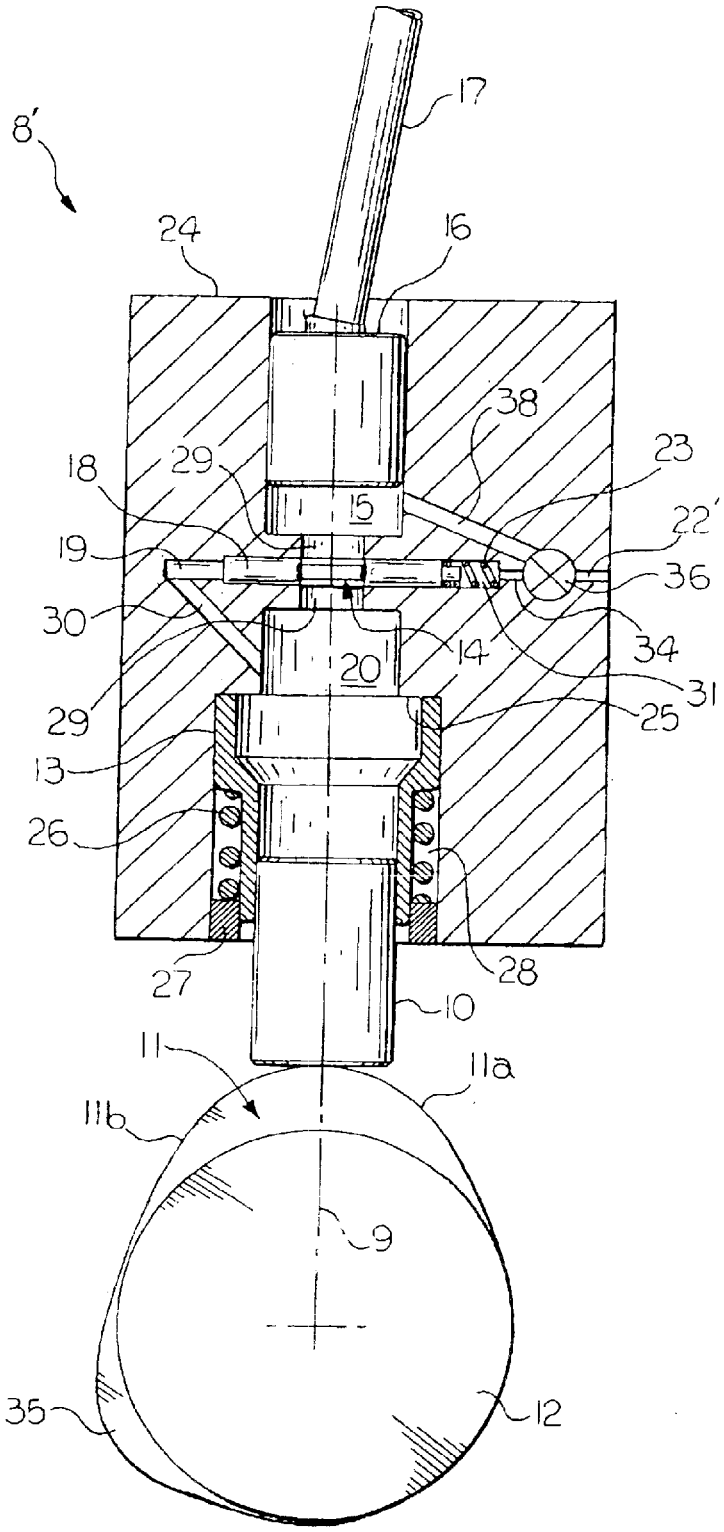
FIG. 3 is fragmentary schematic partial cross-sectional view of an alternative embodiment of a valve deactivation apparatus in accordance with the present invention installed in an engine block.

Referring now to FIG. 3, an alternative embodiment of a spool valve lost motion deactivation apparatus is indicated generally at 8'. The apparatus 8' is similar to the apparatus 8 of FIGS. 1 and 2 and corresponding elements have the same reference numerals and are not described in detail below. The apparatus 8' includes a three-port switching solenoid control valve 36 that selectively connects the spring chamber 31 with a lube oil supply passage 22', similar to the lube oil supply passage 22 of FIGS. 1 and 2, and a lube oil passage 38 that extends from and is in fluid communication with the upper chamber 15. The lube oil passage 38 does not include a check valve, such as the check valve 32 of FIGS. 1 and 2.

The operation of the lost motion deactivation apparatus 8' is as follows. In a full lift operation, the solenoid control valve 36 is in a first connection position with the spool valve 14 in an open position, wherein the spring chamber 31 is in fluid communication with the upper chamber 15 through the lube oil passage 38 and the spring chamber 31 is isolated from the lube oil supply passage 22'. When the cam 12 rotates in a clockwise direction and a first ramped portion 11*a* of the outer surface of the cam lobe 11 engages with a lower surface of the follower piston 10, the follower piston 10 moves upwardly and displaces oil in the sleeve 13 and the lower chamber 20. Since the spool valve 14 is open, the oil displaced by the follower piston 10 passes through the second passage 29 and into the upper chamber 15 to move the upper piston 16 upwardly. The movement of the upper piston 16 in turn moves the pushrod 17. With the solenoid control valve 36 in the first position, the lower chamber 20, the first passage 19, the upper chamber 15, and the spring chamber 31 are in fluid communication with each other. The pressure of the oil in the lower chamber 20, the first passage 19, the upper chamber 15, and the spring chamber 31, therefore, is equalized and the spool body 18 remains in place in the open position because of the balanced pressures on the respective control surfaces 18*d*, 18*e*, 18*f*, and 18*g* adjacent the respective chambers and passages 19, 20, and 31.

As the cam 12 continues to rotate, a second ramped portion 11*b* of the cam lobe 11 contacts the follower piston 10, causing the follower piston 10 to lower and lowering the pressure in the sleeve 13 and the lower chamber 20. The lower pressure, in combination with the valve springs attached to the engine valve forcing the upper piston 16 downwardly, cause the follower piston 10 to move downwardly. During the full lift operation described above, the accumulator sleeve 13 is not unloaded and remains stationary. An extra valve event, such as caused by an EGR lobe 35 on the cam 12, operates the apparatus 8' in the same manner in a full lift operation.

In a zero lift operation, the solenoid control valve 36 is in a second connection position with the spool valve 14 in an open position, wherein the spring chamber 31 is in fluid communication with the lube oil supply passage 22' and the spring chamber 31 is isolated from the upper chamber 15. When the cam 12 rotates and the first ramped portion 11*a* of the outer surface of the cam lobe 11 engages with a lower surface of the follower piston 10, the follower piston 10 moves upwardly and displaces oil in the sleeve 13 and the lower chamber 20. Since the spool valve 14 is open, the oil displaced by the follower piston 10 passes through the lower chamber 20, the second passage 29, and the upper chamber 15. As the pressure in the first passage 19 rises above the pressure in the lube oil supply passage 22', because the solenoid control valve 36 prevents oil from flowing from the upper chamber 15 into the lube oil supply passage 22' or the spring chamber 31, the valve control surfaces 18*d* and 18*g* are exposed to different pressures and the spool body 18 is moved against the return spring 23 and the pressure from the supply passage 22'. The first portion 18*a* moves into the second passage 29 to close the valve 14 before the engine valve spring preload is reached, which isolates the upper chamber 15 from oil flow before the engine valve starts to move. After the valve 14 is closed, the lower chamber 20 and the interior of the sleeve 13 are also isolated, increasing the pressure in both as the follower piston 10 rises. The higher pressure acts on the angled surface 13*b* of the accumulator sleeve 13, eventually overcoming the preload of the spring 26 and causing the accumulator 13 to move downwardly. This high pressure may encourage the use of roller followers (not shown) to avoid normal force-driven increases in friction.

As the cam 12 continues to rotate, the second ramped portion 11*b* of the cam lobe 11 contacts the follower piston 10, causing the follower piston 10 to lower and consequently reducing the pressure in the sleeve 13 and the lower chamber 20. As the pressure is reduced, the spring 26 moves the accumulator sleeve 13 upwardly. Eventually the spring 26 returns the energy stored by cam motion back to the cam 12 and the spring 26 returns to a rest position. When the pressure in the lower chamber 20 and the sleeve 13 is reduced, the pressure in the upper chamber 15 and the first passage 19 is also reduced. The pressure on the valve control surfaces 18*d* and 18*g* eventually equalizes allowing the spring 23 to return the valve 14 to the open position. At this point, no oil has flowed through the solenoid control valve 36, and the oil to the accumulator sleeve 13 and back has not been forced to flow through an orifice. The EGR lobe 35 operates the apparatus 8' in the same manner in a zero lift operation.

In a partial lift operation, the solenoid control valve 36 is in the first connection position wherein the spring chamber 31 is in fluid communication with the upper chamber 15 through the lube oil passage 38 and the spring chamber 31 is isolated from the lube oil supply passage 22'. When the cam 12 rotates and the first ramped portion 11*a* of the outer surface of the cam lobe 11 engages with a lower surface of the follower piston 10, the follower piston 10 moves upwardly and displaces oil in the sleeve 13 and the lower chamber 20. Since the spool valve 14 is open and the solenoid control valve 36 is in the first connection position, the oil displaced by the follower piston 10 passes through the lower chamber 20, the second passage 29, and into the upper chamber 15 to move the upper piston 16 upwardly. The upper piston 16 moves in response to the oil flow to drive the pushrod 17, as in the full lift operation outlined above.

At a predetermined point in the motion of the cam 12 corresponding to the desired lift of the engine valve is reached, the solenoid valve 36 is placed in the second connection position, placing the spring chamber 31 in fluid communication with the lube oil supply passage 22' and isolating the spring chamber 31 from the upper chamber 15 through the lube oil passage 38. The pressure on the control surface 18*g* falls below the pressure on the control surface 18*d*, which drives the spool body 18 to the right in FIG. 3 against the combined force of the spring 23 and the lubrication pressure from the lube oil supply passage 22'. Thus, the first portion 18*a* moves into the second passage 29 and closes the valve 14. When the valve 14 is closed, this isolates the upper chamber 15 from the lower chamber 20, freezing the engine valve in position, and allowing the remainder of cam lift to be absorbed by the accumulator 13, as in the zero lift operation outlined above. The valve 14 will remain closed as the follower piston 10 goes over the nose of the cam lobe 11, and the spring 26 of the accumulator 13 returns energy as in the zero lift operation outlined above. As the can 12 rotates, eventually a crank angle will be reached when the follower piston 10 reaches the same lift as at the crank angle when the solenoid control valve 36 was placed in the second connection position. At this point, the pressures in the upper chamber 15 and the lower chamber 20 are again equal (as when the solenoid control valve 36 was placed in the second connection position), and the spool valve 14 begins to open as the pressure in the lower chamber 20 and on the valve control surface 18*d* drops with the closing motion of the follower piston 10 and the cam 12. With the spool valve 14 open, the upper chamber 15 and the lower chamber 20 are in fluid communication, and the engine valve is under control of the cam 12. This particularly includes the closing ramp 11*b* of the cam lobe 11, which advantageously assures acceptable closing velocities and accelerations of the engine valve. Modulation of the apparatus 8' will be by variation of the predetermined crank angle at which the solenoid control valve 36 is placed in the first and the second connection positions, which will advantageously allow the lift of the cam 12 to be varied, and will allow the lift-time area under the valve motion curve to be controlled. Similar partial lift operation can be obtained with the EGR lobe 35.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for deactivating an engine valve in an engine component comprising:

an engine component having a sleeve cavity and an upper chamber formed therein along a common axis, said sleeve cavity and said upper chamber being connected by a fluid flow passage;

an accumulator sleeve mounted for sliding movement along said axis in said sleeve cavity;

a follower piston retained in an interior of said sleeve for sliding movement along said axis, said follower piston adapted to be moved in response to contact with a cam;

an upper piston mounted for sliding movement along said axis in said upper chamber, said upper piston being adapted to activate an engine valve;

a spool valve disposed in said passage, said spool valve being in a normally open position to permit fluid flow through said passage between said sleeve cavity and said upper chamber; and means for selectively actuating said spool valve between a closed position preventing fluid flow through said passage and said open position, whereby when said sleeve cavity, said passage and said upper chamber are filled with fluid, movement of said follower piston along said axis causes corresponding movement of said upper piston for activating a valve when said spool valve is in said open position and causes opposite movement of said accumulator sleeve and no movement of said upper piston for deactivating the valve when said spool valve is in said closed position.

2. The apparatus according to claim 1 wherein said spool valve includes a spool body having a first control surface in fluid communication with said sleeve cavity and a second control surface in fluid communication with said upper chamber.

3. The apparatus according to claim 2 wherein said spool valve includes a first portion having said first control surface formed thereon, a second portion with said second control surface formed thereon, and a third portion extending between and having a smaller diameter than said first and second portions.

4. The apparatus according to claim 2 including a return spring acting on said second control surface and biasing said spool body to said open position.

5. The apparatus according to claim 4 including an extension formed on said second control surface and being received in an end of said return spring.

6. The apparatus according to claim 2 including a control valve connected between said upper chamber and said second control surface, said control valve being selectively operable between a closed mode causing said spool valve to be in said open position and an open mode causing said spool valve to be in said closed position.

7. The apparatus according to claim 1 wherein said upper chamber and said control valve are connected to an oil supply passage formed in said engine component for receiving pressured fluid.

8. The apparatus according to claim 7 including a check valve positioned in said oil supply passage for permitting fluid flow into said upper chamber from said control valve and a source of pressured fluid.

9. The apparatus according to claim 1 wherein said accumulator sleeve is stepped and said follower piston is positioned in a smaller diameter portion of said accumulator sleeve.

10. The apparatus according to claim 1 wherein said accumulator sleeve is stepped and including a return spring surrounding a smaller diameter portion of said accumulator sleeve and biasing said accumulator toward said spool valve.

11. An apparatus for deactivating an engine valve in an engine component comprising:

an engine component having a sleeve cavity and an upper chamber formed therein along a common axis, said sleeve cavity and said upper chamber being connected by a fluid flow passage;

an accumulator sleeve mounted for sliding movement along said axis in said sleeve cavity;

a follower piston retained in an interior of said sleeve for sliding movement along said axis, said follower piston being in contact with a lobe of a cam;

an upper piston mounted for sliding movement along said axis in said upper chamber, said upper piston being operably connected to an engine valve;

a spool valve disposed in said passage, said spool valve being in a normally open position to permit fluid flow through said passage between said sleeve cavity and said upper chamber; and means for selectively actuating said spool valve between a closed position preventing fluid flow through said passage and said open position, whereby when said sleeve cavity, said passage and said upper chamber are filled with fluid, rotation of said cam causes reciprocating movement of said follower piston along said axis and corresponding movement of said upper piston activating said valve when said spool valve is in said open position and causes opposite movement of said accumulator sleeve and no movement of said upper piston deactivating said valve when said spool valve is in said closed position.

12. The apparatus according to claim 11 wherein said spool valve includes a spool body having a first control surface in fluid communication with said sleeve cavity and a second control surface in fluid communication with said upper chamber, said spool valve being in said open position when forces acting on said first and second control surfaces are equal.

13. The apparatus according to claim 12 wherein said spool valve includes a first portion having said first control surface formed thereon, a second portion having said second control surface formed thereon, and a third portion extending between and having a smaller diameter than said first and second portions.

14. The apparatus according to claim 12 including a return spring acting on said second control surface and biasing said spool body toward said open position.

15. The apparatus according to claim 14 including a spring chamber formed in said engine component retaining said return spring and including an extension formed on said second control surface and being received in an end of said return spring.

16. The apparatus according to claim 12 including a control valve connected between said upper chamber and said second control surface, said control valve being selectively operable between a closed mode causing said spool valve to be in said open position and an open mode causing said spool valve to be in said closed position.

17. The apparatus according to claim 11 wherein said upper chamber and said control valve are connected to an oil supply passage formed in said engine component for receiving pressured fluid.

18. The apparatus according to claim 17 including a check valve positioned in said oil supply passage for permitting fluid flow into said upper chamber from said control valve and a source of pressured fluid.

19. The apparatus according to claim 11 wherein said accumulator sleeve is stepped and said follower piston is positioned in a smaller diameter portion of said accumulator sleeve.

20. The apparatus according to claim 19 including a return spring surrounding a smaller diameter portion of said accumulator sleeve and biasing said accumulator toward said spool valve.

* * * * *